US012781964B2

(12) United States Patent
Ceranic

(10) Patent No.: US 12,781,964 B2
(45) Date of Patent: Nov. 3, 2026

(54) COMBUSTOR WITH AIR/FUEL MIXER CREATING MIXED CLOUD

(71) Applicant: Pratt & Whitney Canada Corp., Longueuil (CA)

(72) Inventor: Nemanja Ceranic, Mississauga (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 253 days.

(21) Appl. No.: 18/104,951

(22) Filed: Feb. 2, 2023

(65) Prior Publication Data

US 2024/0263787 A1 Aug. 8, 2024

(51) Int. Cl.
*F23R 3/28* (2006.01)
*F23R 3/14* (2006.01)

(52) U.S. Cl.
CPC ..... *F23R 3/286* (2013.01); *F23R 3/14* (2013.01)

(58) Field of Classification Search
CPC .. F23D 11/103; F23R 3/12; F23R 3/14; F23R 3/28; F23R 3/283; F23R 3/286
See application file for complete search history.

(56) References Cited

U.S. PATENT DOCUMENTS 5,431,019 A * 7/1995 Myers ..... F23C 7/002 239/404
5,941,075 A 8/1999 Ansart et al.
6,082,113 A * 7/2000 Prociw ..... F23D 11/107 60/748
6,371,387 B1 4/2002 Nally et al.
7,117,678 B2 * 10/2006 Sampath ..... F02C 1/00 60/740
7,810,333 B2 * 10/2010 Kraemer ..... F23R 3/34 60/737
7,832,212 B2 11/2010 Bunker
(Continued)

FOREIGN PATENT DOCUMENTS

CN 206113000 4/2017
EP 1923637 5/2008
(Continued)

OTHER PUBLICATIONS

European Search Report for EP Application No. 24154529.2 dated May 29, 2024.

*Primary Examiner* — Devon C Kramer
*Assistant Examiner* — Sean V Meiller
(74) *Attorney, Agent, or Firm* — Carlson, Gaskey & Olds, P.C.

(57) ABSTRACT

A combustor for a gas turbine engine includes a liner receiving a fuel and air mixing body. The mixing body communicates with a source of fuel, and has an inner chamber centered on a central axis. Fuel passages communicate with the source of fuel and deliver fuel into the inner chamber. The inner chamber extends between a bottom wall and an end face leading into a combustion chamber within the liner. Inner air swirler passages are formed in the mixing body at an axially intermediate location between the bottom wall and the end wall and deliver air into the inner chamber to mix with fuel from the fuel passages. Outer air passages in the mixing body in a portion which is radially outward of the chamber. The outer air passages have a component extending radially inwardly toward the central axis of the chamber.

13 Claims, 2 Drawing Sheets

(56) References Cited

U.S. PATENT DOCUMENTS

| | | | | |
|---|---|---|---|---|
| 7,870,736 | B2 | 1/2011 | Homitz et al. | |
| 8,047,003 | B2 | 11/2011 | Yoshida et al. | |
| 8,266,911 | B2 | 9/2012 | Evulet | |
| 8,413,445 | B2 | 4/2013 | Poyyapakkam | |
| 8,539,773 | B2 | 9/2013 | Ziminsky et al. | |
| 8,661,779 | B2 | 3/2014 | Laster et al. | |
| 8,893,500 | B2 | 11/2014 | Oskam | |
| 8,984,889 | B2 * | 3/2015 | Wilbraham | F23R 3/14 60/737 |
| 9,284,933 | B2 | 3/2016 | Myers | |
| 9,771,869 | B2 | 9/2017 | Li et al. | |
| 9,976,522 | B2 | 5/2018 | Patel et al. | |
| 10,082,294 | B2 | 9/2018 | Laster et al. | |
| 10,267,522 | B2 | 4/2019 | Ciani et al. | |
| 10,502,425 | B2 | 12/2019 | Boardman et al. | |
| 10,704,786 | B2 | 7/2020 | Laster et al. | |
| 10,865,989 | B2 | 12/2020 | Sadasivuni | |
| 10,941,940 | B2 | 3/2021 | Bulat et al. | |
| 11,067,280 | B2 | 7/2021 | Boardman et al. | |
| 2005/0217270 | A1 | 10/2005 | Sampath et al. | |
| 2010/0170253 | A1 | 7/2010 | Berry et al. | |
| 2011/0185703 | A1 | 8/2011 | Dodo et al. | |
| 2012/0227411 | A1 | 9/2012 | Carroni et al. | |
| 2014/0075949 | A1 | 3/2014 | Prociw | |
| 2017/0227224 | A1 | 8/2017 | Oskam et al. | |
| 2017/0307210 | A1 | 10/2017 | Hirano et al. | |
| 2021/0172413 | A1 | 6/2021 | Snyder | |
| 2022/0268213 | A1 | 8/2022 | Morenko et al. | |
| 2022/0290862 | A1 | 9/2022 | Kediya et al. | |

FOREIGN PATENT DOCUMENTS

| | | | |
|---|---|---|---|
| EP | 3078913 | A1 | 10/2016 |
| IN | 101220955 | | 7/2008 |
| JP | 2013108667 | | 6/2013 |
| JP | 5538113 | | 7/2014 |
| JP | 5926635 | | 5/2016 |
| WO | 2016051756 | | 4/2016 |
| WO | 2020259919 | | 12/2020 |

* cited by examiner

COMBUSTOR WITH AIR/FUEL MIXER CREATING MIXED CLOUD

BACKGROUND

This application relates to a combustor for a gas turbine engine wherein a mixing body mixes fuel and air to create an expanding cloud of mixed fluid.

Gas turbine engines are known, and typically include a compressor delivering compressed air into a combustor. Compressed air is mixed with fuel and ignited. Products of the combustion pass downstream over turbine rotors, driving them to rotate. The turbine rotors in turn rotate the compressor rotors and propulsor rotors such as a fan or propeller.

Historically, aviation fuel has been utilized with gas turbine engines, especially for aircraft applications. More recently it has been proposed to utilize hydrogen ($H_2$) as a fuel.

SUMMARY

A combustor for a gas turbine engine includes a liner receiving a fuel and air mixing body. The mixing body communicates with a source of fuel, and has an inner chamber centered on a central axis. Fuel passages communicate with the source of fuel and deliver fuel into the inner chamber. The inner chamber extends between a bottom wall and an end face leading into a combustion chamber within the liner. Inner air swirler passages are formed in the mixing body at an axially intermediate location between the bottom wall and the end wall and deliver air into the inner chamber to mix with fuel from the fuel passages. Outer air passages in the mixing body in a portion which is radially outward of the chamber. The outer air passages have a component extending radially inwardly toward the central axis of the chamber.

These and other features will be best understood from the following drawings and specification, the following is a brief description.

DETAILED DESCRIPTION

Figure 1:
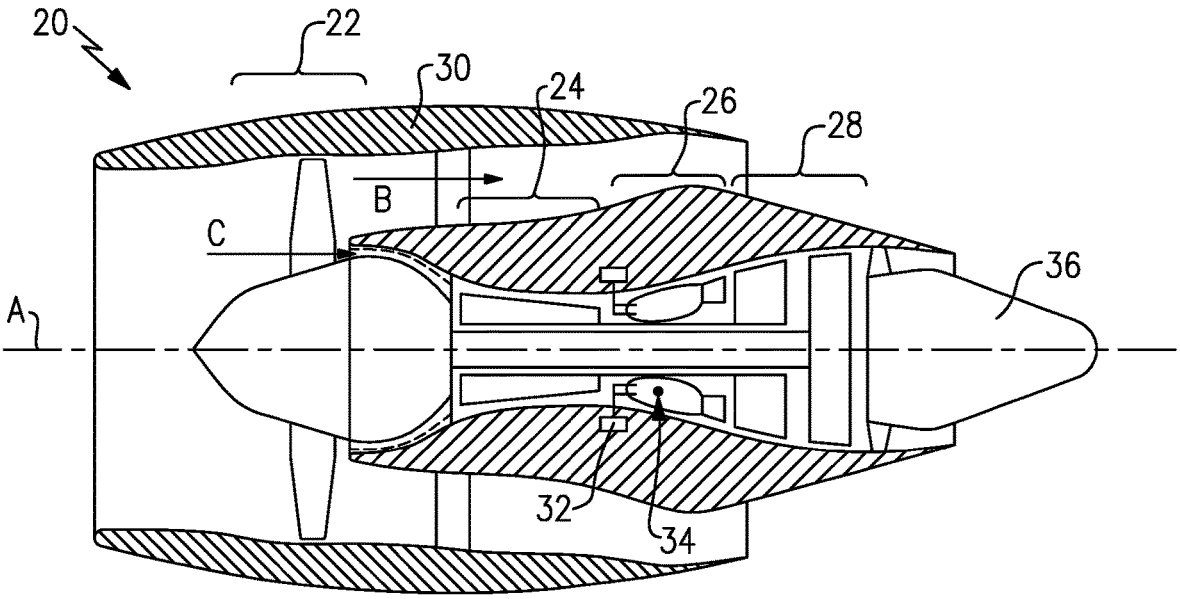
FIG. 1 schematically shows a gas turbine engine.

FIG. 1 schematically illustrates a gas turbine engine 20. The example gas turbine engine 20 is a turbofan that generally incorporates a fan section 22, a compressor section 24, a combustor section 26 and a turbine section 28. The fan section 22 drives air along a bypass flow path B in a bypass duct defined within a nacelle 30. The turbine engine 20 intakes air along a core flow path C into the compressor section 24 for compression and communication into the combustor section 26. In the combustor section 26, the compressed air is mixed with fuel from a fuel system 32 and ignited by igniter 34 to generate an exhaust gas flow that expands through the turbine section 28 and is exhausted through exhaust nozzle 36. Although depicted as a turbofan turbine engine in the disclosed non-limiting embodiment, it should be understood that the concepts described herein are not limited to use with turbofans as the teachings may be applied to other types of turbine engines. As one example, rather than having the propulsor be an enclosed fan, the propulsor may be an open propeller.

A gas turbine engine as disclosed in this application will utilize hydrogen ($H_2$) as a fuel. Challenges are faced by the use of hydrogen, and in particular combustor structure which might be appropriate for aviation fuel may not be as applicable to hydrogen as a fuel.

One challenge when utilizing hydrogen as a fuel is that it is in a gaseous state and more readily flammable than aviation fuel. This could raise challenges with burn back if ignitions starts too close to the fuel feed.

Figure 2A:
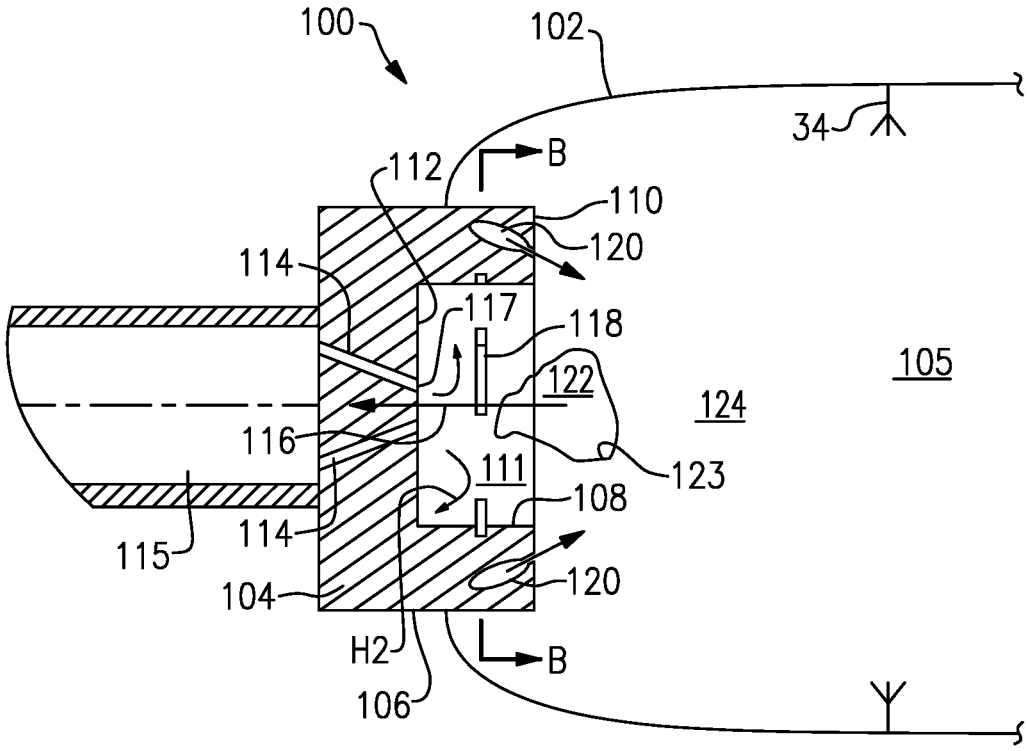
FIG. 2A shows a combustor embodiment according to this disclosure.

FIG. 2A shows a combustor embodiment 100 having a liner 102 (shown partially). Ignitors 34 are shown schematically. A mixing body 104 is attached to an end wall of the combustor 100. The mixing body 104 is generally cylindrical with an outer peripheral surface 106 and an inner cylindrical wall 108 defining a cuplike shape for the mixing body 34 and defining a chamber 111. The chamber 111 extends between an axially inner face 110 leading into a combustor chamber 105 and a bottom end wall 112 of the chamber 111.

Fuel is delivered from passages 114 which communicate with a fuel supply tube 115 into chamber 111 through outlets 117. A center axis 116 of the chamber 111 is also shown. As is clear from FIG. 2A, the passages 114 extend along an axial direction from the passage 115 and radially inwardly, or towards the center axis 116. Thus, when the fuel reaches the chamber 111 it is directed toward the center axis 116 merging together as a single larger jet of gaseous $H_2$.

In embodiment, an angle defined between the fuel supply passage and the central axis 116 between 5° and 75°.

The fuel in disclosed embodiments is hydrogen ($H_2$).

Inner air supply swirlers 118 also supply air into the chamber 111. As shown, inner air supply swirlers enter chamber 111 axially intermediate outlets 117 and inner face 110. The air from the plural swirlers 118 in combination create a sheet or wall of air that causes the outer extends of the merged hydrogen fuel jet to circulate in a radially outer direction as it encounters the air. The fuel jet mixes rapidly with the surrounding air and the mixture moves toward an area 122 outwardly of the end face 110. The mixed fuel and air here expands outwardly, while continuously mixing, as a cloud shape shown at 123.

Outer air passages 120 deliver air with a radially inward direction again toward the center line 116. Due to this direction the majority of the outer air leaving the outer air passages 120 extend with a component in an axially downstream direction and a radially inward direction. The outer air passages are in a portion of mixing body 104 radially outward of chamber 111. These outer air flows contain the cloud 123 such that it moves downstream without expanding outwardly to a great extent. In this manner, combustion is moved downstream within a controlled spray cone angle and away from the fuel passages 114.

The outer air passages 120 include a plurality of outer air passages 120 intermediate each of the inner air swirler passages 118.

Figure 2B:
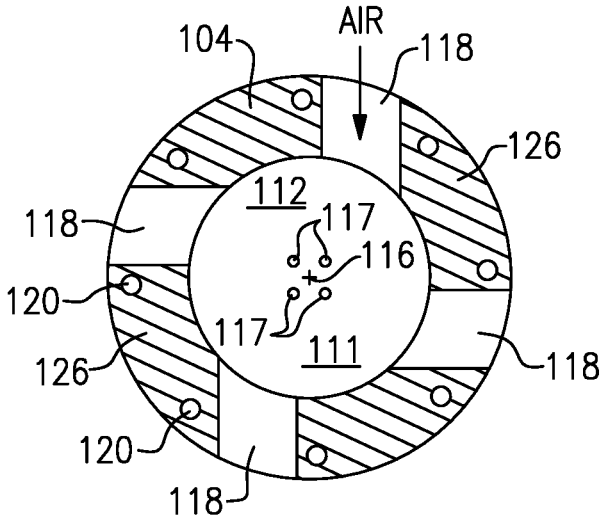
FIG. 2B is a cross-sectional view along line B-B of FIG. 2A.

As shown in FIG. 2B, the chamber 111 has the end wall 112. Fuel passages 114 all extend radially toward the center axis 116. The inner air swirler passages 118 extend generally tangent to the center axis 116, but the combination of the plurality of passages 118 results in the air swirling within the chamber 111 and forming the sheet or wall as described above. The outer air passages 120 are also shown in sections 126 of the mixing body 104 which are circumferentially intermediate the swirler passages 118.

Figure 3A:
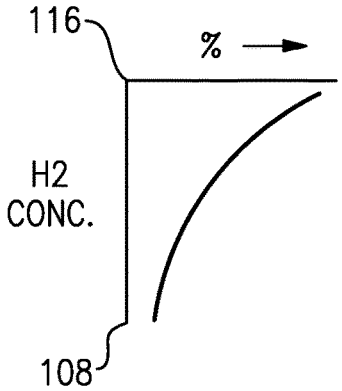
FIG. 3A shows a concentration of fuel heading from an axially outer face of a mixing body to an entry end of the mixing body.

FIG. 3A shows the hydrogen concentration between the center axis 116 to the inner periphery 108. As shown, at least initially the fuel is concentrated adjacent the center line at the axial position of the inner air supply swirlers 118.

Figure 3B:
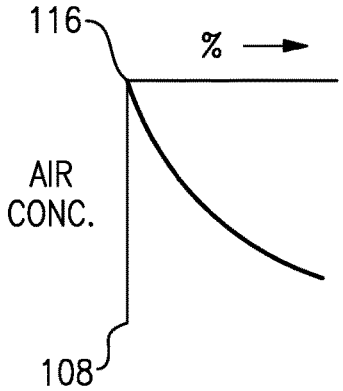
FIG. 3B shows a concentration of air heading from an axially outer face of a mixing body to an entry end of the mixing body.

FIG. 3B in contrast shows the air concentration is highest at the inner periphery 108 and decreases heading toward the center line 116 at the axial position of the inner air supply swirlers 118. The airflow all wants to rotate clockwise out of the page of FIG. 2B as it flows along the chamber wall. The radial momentum of the air is high enough to promote more of the airflow sticking to the wall of the chamber while the fuel fills the central portion and provides a positive pressure, thus preventing the air from rushing towards the center In a featured embodiment, a combustor 100 for a gas turbine engine under this disclosure could be said to include a liner 102 receiving a fuel and air mixing body 104. The mixing body 104 communicates with a source of fuel 115, and has an inner chamber 111 centered on a central axis 116. Fuel passages 114 communicate with the source of fuel and deliver fuel into the inner chamber 111. The inner chamber 111 extends between a bottom wall 112 and an end face 110 leading into a combustion chamber 105 within the liner 102. Inner air swirler passages 118 are formed in the mixing body 104 at an axially intermediate location between the bottom wall 112 and the end wall 110 and for delivering air into the inner chamber 111 to mix with fuel from the fuel passages 114. Outer air passages 120 in the mixing body 104 in a portion which is radially outward of the chamber 111. The outer air passages 120 have a component extending radially inwardly toward the central axis 112 of the chamber 111.

In another embodiment according to the previous embodiment, the source of fuel is a source of hydrogen.

In another embodiment according to any of the previous embodiments, the fuel passages 114 extend from a fuel supply 115 through outlets 117 with an angle having a component in an axially outward direction and with a radially inward component toward the center axis.

In another embodiment according to any of the previous embodiments, the outer air passages include a plurality of outer air passages 120 intermediate each of the inner air swirler passages 118.

In another embodiment according to any of the previous embodiments, the outer air passages include a plurality of outer air passages intermediate each of the inner air swirler passages.

In another embodiment according to any of the previous embodiments, a concentration of air in the inner chamber increases from the central axis to an inner wall defining the inner chamber, and a concentration of fuel in the inner chamber increases from the inner wall to the central axis.

In another embodiment according to any of the previous embodiments, the fuel passages 114 extend from a fuel supply passage 115 through outlets 117 with an angle having a component in an axially outward direction and with a radially inward component toward the center axis.

In another embodiment according to any of the previous embodiments, the outer air passages include a plurality of outer air passages 120 intermediate each of the inner air swirler passages 118.

In another embodiment according to any of the previous embodiments, the outer air passages include a plurality of outer air passages 120 intermediate each of the inner air swirler passages 118.

In another embodiment according to any of the previous embodiments, a concentration of air in the inner chamber increases from the central axis to an inner wall defining the inner chamber, and a concentration of fuel in the inner chamber increases from the inner wall to the central axis.

A gas turbine engine incorporating any of the above features is also disclosed and claimed.

Although embodiments have been disclosed, a worker of skill in this art would recognize that modifications would come within the scope of this disclosure. For that reason, the following claims should be studied to determine the true scope and content.

What is claimed is:

1. A combustor for a gas turbine engine comprising: a liner receiving a fuel and air mixing body; the fuel and air mixing body communicating with a fuel supply, and having an inner chamber centered on a central axis, and fuel passages communicating with the fuel supply and for delivering fuel into the inner chamber, and the inner chamber extending between a bottom wall and an end wall leading into a combustion chamber within the liner; inner air swirler passages formed in the fuel and air mixing body at an axially intermediate location between the bottom wall and the end wall and for delivering air into the inner chamber to mix with fuel from the fuel passages; outer air passages in the fuel and air mixing body in a portion which is radially outward of the inner chamber, and the outer air passages having an outer component extending radially inwardly toward the central axis of the inner chamber; wherein the fuel passages extend from the fuel supply through outlets with an angle having a fuel axial component in an axially outward direction and a fuel radial component in a radially inward direction toward the center axis; and wherein a majority of outer air leaving the outer air passages extends with a leaving component in an axially downstream direction and a radially inward direction.

2. The combustor as set forth in claim 1, wherein the fuel supply is a source of hydrogen.

3. The combustor as set forth in claim 2, wherein a concentration of air in the inner chamber increases from the central axis to an inner wall defining the inner chamber, and a concentration of fuel in the inner chamber increases from the inner wall to the central axis.

4. The combustor as set forth in claim 1, wherein the outer air passages include a plurality of outer air passages intermediate each of the inner air swirler passages.

5. The combustor as set forth in claim 1, wherein a concentration of air in the inner chamber increases from the central axis to an inner wall defining the inner chamber, and a concentration of fuel in the inner chamber increases from the inner wall to the central axis.

6. A gas turbine engine comprising: a compressor section and a turbine section with an intermediate combustor having a liner receiving a fuel and air mixing body; the fuel and air mixing body communicating with a fuel supply, and having an inner chamber centered on a central axis, and fuel passages for communicating with the fuel supply and for delivering fuel into the inner chamber, and the inner chamber extending between a bottom wall and an end wall leading into a combustion chamber within the liner; inner air swirler passages formed in the fuel and air mixing body at an axially intermediate location between the bottom wall and the end wall and for delivering air into the inner chamber to mix with fuel from the fuel passages; and outer air passages in the fuel and air mixing body in a portion which is radially outward of the inner chamber, and the outer air passages having an outer component extending radially inwardly toward the central axis of the inner chamber; wherein the fuel passages extend from the fuel supply through outlets with an angle having a fuel axial component in an axially inward direction and with a fuel radial component in a radially inward direction toward the center axis; and wherein a majority of outer air leaving the outer air passages extends with a leaving component in an axially downstream direction and a radially inward direction.

7. The combustor as set forth in claim 6, wherein the fuel supply is a source of hydrogen.

8. The gas turbine engine as set forth in claim 7, wherein the outer air passages include a plurality of outer air passages intermediate each of the inner air swirler passages.

9. The gas turbine engine as set forth in claim 7, wherein a concentration of air in the inner chamber increases from the central axis to an inner wall defining the inner chamber, and a concentration of fuel in the inner chamber increases from the inner wall to the central axis.

10. The gas turbine engine as set forth in claim 7, wherein the outer air passages include a plurality of outer air passages intermediate each of the inner air swirler passages.

11. The gas turbine engine as set forth in claim 6, wherein the outer air passages include a plurality of outer air passages intermediate each of the inner air swirler passages.

12. The gas turbine engine as set forth in claim 6, wherein a concentration of air in the inner chamber increases from the central axis to an inner wall defining the inner chamber, and a concentration of fuel in the inner chamber increases from the inner wall to the central axis.

13. A gas turbine engine comprising: a compressor section and a turbine section with an intermediate combustor having a liner receiving a fuel and air mixing body; the fuel and air mixing body communicating with a fuel supply, and having an inner chamber centered on a central axis, and fuel passages for communicating with the fuel supply and for delivering fuel into the inner chamber, and the inner chamber extending between a bottom wall and an end wall leading into a combustion chamber within the liner; inner air swirler passages formed in the fuel and air mixing body at an axially intermediate location between the bottom wall and the end wall and for delivering air into the inner chamber to mix with fuel from the fuel passages; and outer air passages in the fuel and air mixing body in a portion which is radially outward of the inner chamber, and the outer air passages having an outer component extending radially inwardly toward the central axis of the inner chamber; wherein the fuel passages extend from the fuel supply through outlets with an angle having an inner axial component in an axially inward direction and with a radially inward component toward the center axis; and wherein a majority of outer air leaving the outer air passages extends with a leaving component in an axially downstream direction and a radially inward direction; wherein the fuel supply is a source of hydrogen; wherein a concentration of air in the inner chamber increases from the central axis to an inner wall defining the inner chamber, and a concentration of fuel in the inner chamber increases from the inner wall to the central axis; and wherein the outer air passages include a plurality of outer air passages intermediate each of the inner air swirler passages.

* * * * *